US006117251A

United States Patent [19]

Rivera

[11] Patent Number: 6,117,251

[45] Date of Patent: Sep. 12, 2000

[54] NO RINSE ZINC PHOSPHATE TREATMENT FOR PREPAINT APPLICATION

[75] Inventor: José B. Rivera, Philadelphia, Pa.

[73] Assignee: Bulk Chemicals, Inc., Reading, Pa.

[21] Appl. No.: 09/275,586

[22] Filed: Mar. 24, 1999

[51] Int. Cl.[7] ..... C23C 22/00

[52] U.S. Cl. ..... 148/251; 148/262

[58] Field of Search ..... 148/250, 259, 148/262, 261, 283

[56] References Cited

U.S. PATENT DOCUMENTS

| | | | |
|---|---|---|---|
| 3,939,014 | 2/1976 | Reed | 148/262 |
| 4,053,328 | 10/1977 | Oka et al. | 148/262 |
| 4,338,141 | 7/1982 | Senzaki et al. . | |
| 4,659,395 | 4/1987 | Sugama et al. . | |
| 5,261,973 | 11/1993 | Sienkowski et al. . | |
| 5,378,292 | 1/1995 | Miller et al. | 148/259 |

OTHER PUBLICATIONS

T. Sugama et al. "Use of Polyacrylic Acid Electrolytes Diffused in Zinc Phosphate Conversion Coatings For the Corrosion Protection of Steel," Journal of Coatings Tech., vol. 61, No. 771, pp. 43–57 (1989).

Kunde et al. "Performance Evaluation of Prephosphated Galvannealed Steel Sheet for Automotive Applications," SAE Technical Paper Series 970152, pp. 21–26 (1997).

Lautensleger et al. "Formability Performance of Prephosphated Galvannealed Sheet Steel," SAE Technical Paper Series 970717, pp. 147–158 (1997).

*Primary Examiner*—John Sheehan
*Assistant Examiner*—Andrew L. Oltmans
*Attorney, Agent, or Firm*—Ratner & Prestia

[57] ABSTRACT

An aqueous solution and method for applying the solution to a metal surface form a zinc phosphate coating on the metal surface. The zinc phosphate coating minimizes corrosion and improves adhesion of subsequently coated materials such as sealants and paints. The solution of the composition and method of application consume free acidity otherwise left on the metal surface, and obviate the need for subsequent rinsing or extensive drying or stoving operations. The composition includes an aqueous solution including water, zinc dihydrogen phosphate, phosphoric acid, a polyhydric polymer, a metal salt, and optionally, a fluoride.

19 Claims, No Drawings

NO RINSE ZINC PHOSPHATE TREATMENT FOR PREPAINT APPLICATION

BACKGROUND OF THE INVENTION

The present invention relates to an aqueous composition for forming zinc phosphate coatings on metal surfaces. When a metal surface is formed, it requires treatment for corrosion resistance and may also require a pre-treatment prior to sealing and/or painting. Zinc phosphate coating solutions are commonly known in the art to pretreat metal surfaces prior to sealing and/or painting. Zinc phosphate coatings isolate corrosion sites. The morphology of the zinc phosphate provides physical anchoring sites for sealing and/or painting solutions which may be applied to the surface in subsequent processing. Zinc phosphate coatings have been successfully used for years to improve the adhesion of paint and other finishes to metal surfaces and to achieve superior corrosion resistance with these finishes.

The drawbacks associated with the application of a zinc phosphate coating solution include the additional process steps which are required in its application. The additional process steps include rinsing and heating the surface after application of the zinc phosphate solution. The rinsing and heating or stoving processes may require a considerable amount of time. The costs associated with these processes include the cost for water rinsing, the disposal of the waste produced after the rinsing process, the equipment and gases and exhaust system used in the heating process, and the processing time used for rinsing and stoving or drying.

The prior art includes solutions and methods for reducing the additional steps associated with the phosphating process and the costs associated with these processes. For example, U.S. Pat. No. 4,659,395 to Sugama et al., provides a process for applying a zinc phosphating solution which does not require subsequent rinsing. However, the prior art of Sugama et al. does require a stoving process to dry the zinc phosphating solution from the surface being treated. The stoving, or other lengthy heating process necessary for drying the surface is time consuming. This is especially undesirable where the metal surface is produced in a continuous process, such as a process whereby a metal sheet is continuously painted at speeds of up to 300 feet per minute, and must be wound around a coil for storage soon after being produced. In this dynamic processing mode, the metal surface must be treated as it is being produced and before it is rolled onto the coil. Therefore, it can be seen that despite advances in the prior art such as those by Sugama et al., a zinc phosphate coating solution which requires neither a rinsing process, nor an extended stoving process for drying, is still lacking in the art.

It is a goal of the present invention to provide a zinc phosphate coating solution which is capable of providing desired adhesion and corrosion resistance qualities by effectively pretreating a metal surface without requiring any additional process operations directed to rinsing or stoving the treated surface.

SUMMARY OF THE INVENTION

To achieve these and other objects, and in view of its purposes, the present invention provides a composition and method for forming a zinc phosphate coating on a metal surface. The present invention also provides a method for producing a zinc phosphate solution to be used for pretreating metal surfaces. The zinc phosphate solution is an aqueous solution including water, zinc dihydrogen phosphate, phosphoric acid, a polyhydric polymer, a metal salt, and optionally, a fluoride ion source. The solution may be formed by mixing water, zinc oxide, phosphoric acid, a polyhydric polymer, a metal salt, and optionally, a fluoride ion source. In the solution, at least some of the zinc oxide and at least some of the phosphoric acid react to form zinc dihydrogen phosphate. Once formed, the zinc dihydrogen phosphate complexes with the metal surface to improve the adhesion of subsequently coated films. It is believed that at least some of the polyhydric polymer and at least some of the phosphoric acid react to form a polyhydric phosphate ester upon drying.

The method for forming the phosphate coating involves contacting the metal surface with the solution of the present invention under process conditions such that a zinc phosphate coating is formed on the metal surface. The process sequence for treating the metal surface according to the present invention, includes cleaning the metal surface, rinsing the surface, optionally activating the surface, treating the surface with the zinc phosphate solution of the present invention, mechanically removing the excess solution from the surface, optionally sealing the surface, and painting the surface. The solution of the present invention may be applied to the metal surface by any suitable method. The distinctive advantage of the present invention is that rinsing is not required after application of the phosphate solution as in most phosphate pre-paint pretreatments, nor is an extensive stoving process required for drying.

It is to be understood that both the foregoing general description and the following detailed description are exemplary, but not restrictive, of the invention.

DETAILED DESCRIPTION OF THE INVENTION

The method and composition of the present invention provide a solution for depositing a zinc phosphate coating on a metal surface which serves as a pretreatment for improving the adhesion of subsequently applied decorative coatings such as paint or other sealants, and which also improves the corrosion resistance of the metal surface. The present invention may be used on a wide variety of metal surfaces, including, but not limited to ferrous or zinc ferrous steel surfaces.

Composition/Method of Formation of the Solution

The composition of the present invention is an aqueous solution including water, zinc dihydrogen phosphate, phosphoric acid, a polyhydric polymer, and a metal salt. Deionized water is used in the preferred embodiment. The zinc dihydrogen phosphate within the solution complexes with the metal surface. Upon drying on the metal surface, it is believed that at least some of the polyhydric polymer and at least some of the phosphoric acid react to form a polyhydric phosphate ester. At any rate, the acidity of the final coating is reduced by the inclusion of the polyhydric polymer.

The aqueous solution including zinc dihydrogen phosphate, may be prepared by mixing the following ingredients: water (preferably deionized water); zinc oxide; phosphoric acid; a polyhydric polymer; and a metal salt. At least some of the zinc oxide and at least some of the phosphoric acid react upon mixing to produce the zinc dihydrogen phosphate. In a preferred embodiment, the solution may be formed by additionally mixing a fluoride ion source. In the preferred embodiment, the fluoride ion source may be ammonium bifluoride, but other fluoride ion sources such as stannous fluoride may be used alternatively. In a preferred embodiment, the polyhydric polymer may be polyvinyl alcohol but other polyhydric polymers may be used. In a preferred embodiment, the metal salt may be cobalt nitrate hexa hydrate, but other salts such as nickel nitrate or stannous fluoride, may also be used. In an alternate embodiment, the solution may be formed by additionally mixing a further acid and a further polymer. In an alternate embodiment including the further acid, hydrofluoric acid may be added.

Although the solution is described above in terms of the constituents mixed together to form the solution, any method for forming an aqueous zinc dihydrogen phosphate solution containing the above additives of a polyhydric polymer and a metal salt, etc, may be used. The present invention is not intended to be limited to forming the zinc dihydrogen solution by mixing zinc oxide and phosphoric acid.

In the preferred embodiment, the zinc dihydrogen phosphate solution of the present invention may be formed by intermixing the above ingredients. In the exemplary embodiment, the relative weight percentages of the components mixed together to form the solution of the present invention, may be as follows:

- the weight percentage of water added to form the mixture may range from about 8.0 to 97.0 percent;
- the weight percentage of the zinc oxide added to form the mixture may range from about 1.00 to 20.0 percent;
- the weight percentage of the phosphoric acid added to form the mixture may range from about 1.50 to 60.0 percent;
- the weight percentage of the polyhydric polymer added to form the mixture may range from about 0.01 to 1.0 percent;
- the weight percentage of the metal salt added to form the mixture may range from about 0.10 to 6.0 percent; and,
- the weight percentage of the fluoride ion source added to form the mixture may range from about 0 to 5.0 percent. (Fluoride is not included in all embodiments).

The components of the zinc phosphate solution of the present invention can either be added individually or premixed in any combination and may be dissolved in water either before or after addition. It is understood that the order of addition is not important in preparing the various zinc dihydrogen phosphate solutions covered by the present invention. The components may be added in any known forms. The aqueous composition is generally produced by the reaction of zinc oxide dispersed in water, with phosphoric acid as will be discussed below. The reaction is exothermic and requires time to cool and completely solubilize.

The intermixing of the zinc oxide with the phosphoric acid within the aqueous solution may be done at the same time or prior to the addition of the other components. In an alternate embodiment, a premixed solution of zinc dihydrogen phosphate may be used. It can be seen that the mixing sequence and procedure is not critical to the present invention. For example, in one embodiment, the polyhydric material such as polyvinyl alcohol may be directly added to the zinc dihydrogen phosphate solution prior to the time of surface treatment. In an alternative embodiment, a separately formed polyhydric polymer solution may be added to the zinc dihydrogen phosphate solution at the time of surface treatment.

It can be further seen that the relative weight percentages of the constituents which form the solution may be varied. As such, the relative weight percentages of the constituents mixed to form the present invention are not critical. The solution formed from components mixed together with weight percentages differing from those in the exemplary embodiment may still be included within the scope of the present invention. Zinc oxide and phosphoric acid react according to a stoichiometric ratio of 1:2 (zinc oxide:phosphoric acid). Accordingly, the relative amounts of zinc oxide and phosphoric acid mixed together will preferably fall within a stoichiometric range of 1:1.5–2.5. The polyhydric polymer of polyvinyl alcohol reacts with phosphoric acid according to a 1:1 stoichiometric ratio (hydroxyl group:phosphoric acid). Accordingly, the relative amounts of polyvinyl alcohol and phosphoric mixed together, will preferably fall within a stoichiometric range of 0.5–1.5: 1. According to a preferred composition, the amounts of zinc oxide and the polyhydric polymer are chosen so that, together, they are in stoichiometric excess of the phosphoric acid.

Within the weight percentage ranges noted above in the exemplary embodiment, the relative weight percentages of the components mixed to form the present invention in a preferred embodiment may be as follows:

| Example Formula | Weight Percent |
|---|---|
| Deionized water | 24.80 |
| Zinc Oxide | 14.42 |
| Phosphoric Acid (75%) | 57.55 |
| Cobalt Nitrate Hexa Hydrate | 2.37 |
| Polyvinyl Alcohol | 0.83 |
| Ammonium Bifluoride | 0.03 |

Various exemplary embodiments have been developed for different industrial applications. The various embodiments each include the common factor of zinc dihydrogen phosphate and a polyhydric polymer. The polyhydric polymer quenches the reactivity of the phosphating composition, and also provides for the wetting of the substrate by the formulations being applied. The following examples demonstrate the versatility and range of the compositions as well as the wide latitude in application methods available.

EXAMPLE I

At a coil galvanizing line, components were mixed according to the following formula to form a solution to provide a dense matte coating upon a metal surface.

| Example Formula I | Weight Percent |
|---|---|
| Deionized Water | 65.37 |
| Zinc Oxide | 8.00 |
| Phosphoric Acid | 19.27 |
| Hydrofluoric Acid | 0.79 |
| Cobalt Nitrate Hexa Hydrate | 4.74 |
| Stannous Fluoride | 1.33 |
| Poly Vinyl Alcohol | 0.500 |

This application was directed to a coating for providing a non-reflective surface for galvanized corner beads. This property is desirable since galvanized steel normally reflects light when used. Further, this galvanizer facility had no room for further tanks (i.e. for rinsing) as would be required to apply conventional zinc phosphate coatings available in the art. With the above formula, no rinsing was required. A direct roll coater was used to apply the coating. The coating of the present invention produced a matte surface having reduced reflectivity, as desired.

EXAMPLE II

In another exemplary embodiment, galvanized coil steel was pre-treated by a solution formed by mixing components according to the following formula:

| Example Formula II | Weight Percent |
|---|---|
| Deionized Water | 62.8894 |
| Zinc Oxide | 8.6119 |
| Phosphoric Acid | 25.7649 |
| Hydrofluoric Acid | 0.2438 |
| Cobalt Nitrate Hexa Hydrate | 1.9900 |
| Poly Vinyl Alcohol | 0.5000 |

A solution having the above composition was applied to the galvanized steel which was subsequently dried and painted. The paint adhesion was found to be excellent and "salt fog" performance was also found to be also excellent. Once again, the conventional rinsing tanks normally required for phosphating a metal surface, were not required.

EXAMPLE III

Another exemplary embodiment comprised a solution formed by mixing components according to the following formula:

| Example Formula III | Weight Percent |
|---|---|
| Deionized Water | 43.0630 |
| Zinc Oxide | 13.3496 |
| Phosphoric Acid | 39.9388 |
| Nickel Nitrate Solution (13% Nickel) | 3.3986 |
| Poly Vinyl Alcohol | 0.2500 |

A galvanized steel sheet was dipped in a tank containing a 30% solution of the above composition. Upon exiting the dip tank, the sheet was not rinsed, as would be required using conventional processing. Rather, it was dried and painted. The paint adhesion in this case was found to be superior to that normally obtained. Further, the normal practice of applying the zinc phosphate coating by spraying, then rinsing the sheet several times with water to produce the zinc phosphate coated substrate, was not required. With the above formula, no rinsing was required providing considerable cost savings with respect to water usage and waste treatment of the rinse water.

Method of Surface Treatment

The method for pretreating a metal surface, in which the present invention is used as a phosphating agent, can best be described as follows. A metal surface may be initially cleaned using any conventional means available in the art. For example, the use of an alkaline aqueous type cleaner is common. The clean substrate is then rinsed to remove residues and contaminants from the cleaning step. This cleaned and rinsed metal surface may then be activated according to a preferred embodiment. In a preferred embodiment, the activation may comprise a mechanical activation accomplished by lightly abrading the cleaned metal surface. In an alternate embodiment, the activation may be done using a titanium phosphate-containing colloidal solution as is standard in the industry.

The activated metal surface is then contacted with the aqueous solution of the present invention. The method for contacting the metal surface to the present invention may include spray squeegeeing, dip squeegeeing, flood squeegeeing, direct roll coating, or reverse roll coating. By spray squeegeeing, dip squeegeeing, and flood squeegeeing, it is meant that the metal surface is brought into contact with the aqueous solution by spraying, dipping or flooding, respectively, then allowed to react with the larger portion of the aqueous solution before the excess is subsequently removed by squeegeeing according to conventional methods. Conventional squeegeeing methods include wiping, sweeping, or pressing the metal surface with a leather or plastic implement. However, the method for applying the present solution to the metal surface is not seen to be limited to the foregoing specific methods. For example, the surface treatment may be carried out by simply immersing the metal surface within a bath containing the solution. Any application method which introduces the solution of the present invention onto the metal surface to be treated, then allows the metal surface to react with a larger portion of the solution before the excess is removed, will be suitable. Further, any suitable set of process conditions for reacting the metal surface with the solution whereby the zinc dihydrogen phosphate solution forms a coating on the metal coating, may be chosen.

When the zinc dihydrogen phosphate solution reacts with the metal surface, a coating is produced on the metal surface. This coating, which may be crystalline in some exemplary embodiments, improves adhesion of subsequently applied films or sealants by providing anchoring sites for the films or sealants. The coating also improves corrosion resistance of the metal surface. After this application process, the excess unreacted solution and excess coating may be mechanically removed by way of squeegeeing, blowing the surface dry with an "air gun", or by using other mechanical means to remove the excess solution from the surface.

After the pretreating and mechanical removal operation operations are completed, the surface does not require an extended stoving or other heating operation, but merely requires drying in air. Drying occurs essentially immediately upon the solution being mechanically removed from the surface, and when the surface is exposed to an ambient environment such as air. The dried surface does not require a rinsing operation.

The distinctive advantage of the present invention lies in the composition of the zinc dihydrogen phosphate solution. Because of the composition of the solution, the surface does not require any dedicated rinsing or stoving operations subsequent to the application of the phosphating solution.

Zinc dihydrogen phosphate $Zn(H_2PO_4)_2$ within the solution reacts with the metal surface and forms a coating upon the metal surface being treated. After this treatment process is complete and the coating is formed on the surface, the excess solution is mechanically removed from the surface by a process such as squeegeeing or other mechanical means, or the surface may be removed from the solution. Upon mechanically removing the solution from the surface, most of the water essentially dries instantly or evaporates, or it may be dried by blowing the surface with an air gun or using other mechanical means. However, some of the excess, acidic phosphating solution remains on the surface. An acidic condition on the surface is undesirable, and causes problems during subsequent coating and painting operations. Hence, the use of water rinsing to remove the excess acid is required using conventional zinc phosphating processes. This rinsing step is necessitated due to excess acid and other components in conventional solutions. In the case of the prior art of Sugama et al., rinsing is not required, but the excess acid must be removed from the surface by driving the reaction between the metal surface and the excess acid by means of stoving.

In the present invention, the excess acidity is presumably consumed upon drying by reaction with the polyhydric polymer which is present in excess in the wet film remaining on the surface. This dried coating does not require rinsing as with the conventional systems or stoving as with Sugama et al. After mechanically removing the solution according to the present invention, and exposing the substrate to an ambient environment such as air, the surface is substantially dried and the acid substantially consumed.

The polyhydric material which is any polymer having hydroxyl groups such as polyethylene glycol, or, preferably polyvinyl alcohol, quenches the acid remaining in the dried coating on the surface. Presumably, the acid is quenched by reacting with the polyhydric polymer to form a polyhydric phosphate ester. It is believed that the available hydroxyl groups of the polyhydric material react with hydrogen from the acid to form water and a polyhydric phosphate ester. For example, the following reaction between polyvinyl alcohol and phosphoric acid may be illustrative:

$$H_3PO_4+PVA \longleftrightarrow H_2O\uparrow+PVA\text{-phosphate ester}$$

At any rate, the excess acidity on the surface is reduced by the addition of the polyhydric polymer to the solution. The free acidity of the coating is quenched, leaving very little acidity on the surface. Rinsing is not required. Since the acidity is quenched, the dried, coated metal surface, is in condition to be painted or further coated with an optional additional corrosion inhibiting solution such as presently employed in the industry, or may be coated with another sealant. The additional coating may then be dried and the surface painted. The final painted metal surface achieved using the present invention includes properties as are normally desired in the industry. Specifically, this final product has the desired paint adhesion qualities and corrosion resistance. Thus, a practical process is achieved for industrial production.

Although illustrated and described herein with reference to certain specific embodiments and example, the present invention is nevertheless not intended to be limited to the details shown. For example, other methods of applying the phosphating solution or removing it from the surface, may be used. Means other than mechanical means may be used to physically remove the solution and/or the product water, from the surface. The concentration of the various components which comprise the solution may also be varied and still remain within the scope of the present invention. The cleaning, rinsing, activating, sealing, and painting processes may also vary from those detailed above while still remaining within the scope of the present invention. The details presented are not presented to limit the scope of the present invention. Rather, the claims should be read to include various modifications within the scope and range of equivalents of the claims, without departing from the spirit of the invention.

What is claimed:

1. A method for forming a zinc phosphate coating on a metal surface comprising contacting the metal surface with an aqueous solution formed by mixing water, zinc oxide, phosphoric acid, polyvinyl alcohol, and a metal salt.

2. The method of claim 1, wherein a fluoride ion source is additionally mixed in forming said aqueous solution.

3. The method of claim 1, wherein at least some of said zinc oxide and at least some of said phosphoric acid react to form zinc dihydrogen phosphate.

4. The method of claim 1, wherein at least some of said polyvinyl alcohol and at least some of said phosphoric acid react to produce a polyhydric phosphate ester.

5. The method of claim 2, wherein:

the weight percentage of said water mixed to form said aqueous solution is from about 8 percent to about 97 percent;

the weight percentage of said zinc oxide mixed to form said aqueous solution is from about 1 percent to about 20 percent;

the weight percentage of said phosphoric acid mixed to form said aqueous solution is from about 1.5 percent to about 60 percent;

the weight percentage of said polyvinyl alcohol mixed to form said aqueous solution is from about 0.01 percent to about 1 percent;

the weight percentage of said metal salt mixed to form said aqueous solution is from about 0.10 percent to about 6 percent; and the weight percentage of said fluoride ion source mixed to form said aqueous solution is less than or equal to about 5 percent.

6. A method for forming a zinc phosphate coating on a metal surface comprising contacting the metal surface with an aqueous solution including water, zinc dihydrogen phosphate, phosphoric acid, polyvinyl alcohol, and a metal salt.

7. The method of claim 6, wherein said aqueous solution further includes a fluoride ion source.

8. The method of claim 6, wherein said metal salt comprises one of cobalt nitrate hexa hydrate and nickel nitrate.

9. The method of claim 6, wherein said aqueous solution further includes a further polymer.

10. The method of claim 6, wherein said contacting comprises applying said solution to said metal surface by one of a) spraying then squeegeeing, b) dipping then squeegeeing, c) flooding then squeegeeing, d) direct roll coating, and e) reverse roll coating.

11. A method for preparing a zinc phosphate coating solution for metal surfaces comprising intermixing water, zinc oxide, phosphoric acid, polyvinyl alcohol, a metal salt, and a fluoride ion source.

12. The method as in claim 11, wherein said metal salt comprises cobalt nitrate hexa hydrate.

13. The method of claim 11, wherein:

the weight percentage of said water mixed to form said coating solution is from about 8 percent to about 97 percent;

the weight percentage of said zinc oxide mixed to form said coating solution is from about 1 percent to about 20 percent;

the weight percentage of said phosphoric acid mixed to form said coating solution is from about 1.50 percent to about 60 percent;

the weight percentage of said polyvinyl alcohol mixed to form said coating solution is from about 0.01 percent to about 1.0 percent;

the weight percentage of said metal salt mixed to form said coating solution is from about 0.10 percent to about 6 percent; and the weight percentage of said fluoride ion source mixed to form said coating solution is less than or equal to about 5 percent.

14. A composition for forming a phosphate coating on metal surfaces, comprising an aqueous solution including water, zinc dihydrogen phosphate, phosphoric acid, polyvinyl alcohol, and a metal salt.

15. The composition as in claim 14, wherein said aqueous solution further includes a fluoride ion source.

16. The composition as in claim 15, wherein said fluoride ion source comprises ammonium bifluoride.

17. The composition of claim 14, wherein said metal salt comprises one of cobalt nitrate hexa hydrate and nickel nitrate.

18. The composition as in claim 14, wherein said aqueous solution further includes a further polymer.

19. A composition of a zinc phosphate coating solution for metal surfaces, formed from a mixture of water, zinc oxide, phosphoric acid, polyvinyl alcohol, a metal salt, and a fluoride ion source, wherein:

said water has a weight percentage within said mixture ranging from about 8 percent to about 97 percent;

said zinc oxide has a weight percentage within said mixture ranging from about 1 percent to about 20 percent;

said phosphoric acid has a weight percentage within said mixture ranging from about 1.5 percent to about 60 percent;

said polyvinyl alcohol has a weight percentage within said mixture ranging from about 0.01 percent to about 1 percent;

said metal salt has a weight percentage within said mixture ranging from about 0.10 percent to about 6 percent; and said fluoride ion source has a weight percentage within said mixture less than or equal to about 5 percent.

* * * * *